US005881527A

United States Patent [19]

Haseotes

[11] Patent Number: 5,881,527

[45] Date of Patent: Mar. 16, 1999

[54] PORTABLE PRECAST CONCRETE SLABS FOR STORAGE FACILITY

[75] Inventor: Byron Haseotes, Southboro, Mass.

[73] Assignee: Hasco, L.P., Southboro, Mass.

[21] Appl. No.: 426,047

[22] Filed: Apr. 21, 1995

[51] Int. Cl.[6] ..... E04B 1/38

[52] U.S. Cl. ..... 52/705; 52/795; 52/796; 52/745.21

[58] Field of Search ..... 52/596, 250, 582.1, 52/600, 125.5, 602, 299, 294, 295, 296, 651.01, 651.05, 698, 705, 741.15, 745.21, 166, 162, 163

[56] References Cited

U.S. PATENT DOCUMENTS

| | | | |
|---|---|---|---|
| 375,999 | 1/1888 | Jackson . | |
| 617,492 | 1/1899 | Love | 52/705 |
| 637,420 | 11/1899 | Robbins | 52/651.01 |
| 1,259,698 | 3/1918 | Wilson . | |
| 1,721,198 | 7/1929 | Athey . | |
| 2,299,070 | 10/1942 | Rogers et al. . | |
| 2,299,071 | 10/1942 | Rogers et al. . | |
| 2,299,111 | 10/1942 | Rogers et al. . | |
| 2,372,200 | 3/1945 | Hayes . | |
| 2,971,295 | 2/1961 | Reynolds | 52/294 X |
| 2,995,900 | 8/1961 | Hunsucker | 52/651.01 X |
| 3,184,892 | 5/1965 | Silberkuhl et al. | 52/223.6 |
| 3,195,277 | 7/1965 | Greulich | 52/223.6 |
| 3,258,888 | 7/1966 | Lum . | |
| 3,956,864 | 5/1976 | Fung . | |
| 4,051,642 | 10/1977 | Terry | 52/294 X |
| 4,120,133 | 10/1978 | Rodgers et al. . | |
| 4,129,968 | 12/1978 | Royer . | |
| 4,199,908 | 4/1980 | Teeters | 52/296 X |
| 4,412,407 | 11/1983 | Melfi et al. | 52/705 |
| 4,751,803 | 6/1988 | Zimmerman . | |
| 4,989,389 | 2/1991 | Maechtle et al. | 52/705 |
| 5,065,558 | 11/1991 | Boatsman . | |
| 5,103,604 | 4/1992 | Teron . | |
| 5,121,579 | 6/1992 | Hamar et al. | 52/582.1 |
| 5,138,813 | 8/1992 | Cooney et al. | 52/600 |
| 5,157,890 | 10/1992 | Jines | 52/582.1 |
| 5,218,795 | 6/1993 | Horstketter | 52/125.5 |
| 5,283,996 | 2/1994 | Myers | 52/596 X |

*Primary Examiner*—Michael Safavi
*Attorney, Agent, or Firm*—Medlen & Carroll, LLP

[57] ABSTRACT

A portable, precast, steel-reinforced concrete slab of given dimensions for use in the floor of a building such as a storage facility. The slab is anchored to the ground using winged pipes, which are designed so as to be easy to insert into the ground but difficult to remove. A method of erecting a frame of a structure on the slab, where a U-clip is used to connect the elements of the frame to a plurality of expanded coil inserts sunk into the slab.

12 Claims, 15 Drawing Sheets

PORTABLE PRECAST CONCRETE SLABS FOR STORAGE FACILITY

FIELD OF THE INVENTION

The present invention relates to portable construction materials and particularly to portable precast concrete slabs for use as floors for storage facilities and other types of buildings.

BACKGROUND OF THE INVENTION

The use of portable or relocatable structures that can readily be transferred to another location is very important in today's society. Business owners often lease land rather than purchase it; due to the limited duration of their leases, it is unfeasible for these business owners to construct small, permanent buildings when they know that they will be moving shortly. Similarly, prudent business strategy often warrants the use of portable buildings. Investment and accounting principles sometimes make structures permanently affixed to land less desirable than portable structures.

Portable structures also possess other attributes. For example, such structures can be accommodated by much of the currently available industrial property. This property possesses a relatively flat, paved surface that requires no further preparation prior to placement of portable structures. In addition, portable structures can sometimes be used where one would be precluded or reluctant to construct a permanent structure. To illustrate, such structures may be allowed on public utility easements because they can be moved relatively quickly, whereas permanent structures would be strictly forbidden.

Furthermore, non-business persons often prefer the flexibility provided by portable structures over that of permanent structures of similar size and construction. For example, homeowners might choose a portable storage facility or out-building because they do not envision an indefinite need for such a structure.

The advent of relatively light-weight and strong building materials, coupled with novel manufacturing techniques, has increased the ability to construct portable structures possessing many qualities of permanent structures. If small buildings are involved, the use of portable structures may be even more desirable due to their generally lower construction costs.

Two basic types of portable structures exist. The first type involves pre-fabricated structures in which the entire structure can be moved from one location to another. Examples of such portable structures include on-site offices used in the construction industry and classrooms used in schools. These structures are often in the form of trailers that can be towed by a truck to different locations.

While being advantageous for certain purposes, pre-fabricated structures possess several important disadvantages that limit their usefulness in other settings. Initially, because the entire structure is moved, it must be light enough so that it can either be carried or towed between locations by a vehicle. This requisite obviously limits the materials that can be used in the construction of the pre-fabricated structure. Next, deserved or undeserved, a certain stigma has come to be associated with pre-fabricated structures. Pre-fabricated structures, such as mobile homes, are viewed by consumers as lacking the qualities of permanent structures.

The second type of portable structure encompasses portable, pre-fabricated elements that can be used in the construction of a structure. One variation of this type entails manufacturing each element separately, then combining the elements at the desired location. Another variation involves the manufacture of only certain elements; these manufactured elements are then incorporated into the construction of the ultimate structure.

For particular uses, the second type of portable structure possesses several advantages over the first. Because only individual elements are portable, not necessarily the structure in its entirety, stronger, heavier, and more durable materials can be used to manufacture the elements. The elements may also be combined in differing manners, providing great flexibility with regards to the configuration of the ultimate structure. Finally, due to the nature of their construction, these structures are often viewed as being more similar to permanent structures than to traditional portable structures; as such, this second type of structure does not suffer from the aforementioned stigma associated with the pre-fabricated structures.

An important element of a portable structure is the foundation upon which the walls of the structure are built. The preferred type of foundation will obviously depend upon the desired function of the finished structure. Wood, metal or a combination of both are often used in the foundations of portable storage facilities.

The present invention provides a superior alternative to the portable foundations traditionally employed with portable buildings. The foundation of the present invention is stronger and more durable than those generally used with portable structures; it can also be used in conjunction with building materials presently utilized in the construction of the structures of portable buildings. Finally, the foundation of the present invention is designed to provide great flexibility in terms of the types of buildings with which it can accommodate.

SUMMARY OF THE INVENTION

The present invention relates to portable construction materials and particularly to portable precast concrete slabs for use as floors for storage facilities and other types of buildings.

One object of the present invention is the provision of a superior alternative to the portable foundations presently used with portable buildings. Specifically, the present invention contemplates a stronger and more durable foundation than the currently available alternatives.

Another object of the present invention is the provision of a portable precast concrete slab that can be used with building materials common to the construction industry. Thus, there are no restrictions to the type of materials used in the structure ultimately constructed on the concrete slabs.

Still another object of the present invention is the ability to connect several concrete slabs together in order to create a larger surface. Numerous joining means are described that can be used to secure one slab to another.

More specifically, the present invention contemplates a method of erecting a frame of a structure on a portable precast concrete slab, comprising the steps of: (a) providing: (i) a portable precast concrete slab containing an expanded coil insert, (ii) frame connecting means, (iii) means for securing the frame connecting means to the expanded coil insert, and (iv) a frame of a structure; (b) securing the frame connecting means to the expanded coil insert with the securing means; and (c) connecting the secured frame connecting means to the frame, thereby erecting the frame of a structure on the portable precast concrete slab.

In some embodiments, the frame connecting means comprises a U-clip, and in some embodiments, the securing means comprises a lift lag. In one embodiment, the connecting step comprises bolting the frame connecting means to the frame of a structure. The frame of a structure may comprise a vertical beam.

In certain embodiments, the method further comprises anchoring the portable precast concrete slab to the underlying ground with an anchoring means. The anchoring means may comprise a pipe and two wings pivotally coupled to the pipe, the wings capable of separating, such separating thereby securely embedding the pipe in the underlying ground.

The invention further contemplates a precast concrete slab having frame connecting means for erecting a frame of a structure, comprising: (a) a body of concrete serving as a floor for the structure comprising an upper surface, a lower surface, and side surfaces, the body of concrete being portable; (b) a plurality of expanded coil inserts disposed within the body of concrete and extending inward from the upper surface; and (c) frame connecting means secured to the expanded coil inserts at the upper surface of said body of concrete, the frame connecting means capable of connecting to a frame of a structure. The lower surface of the precast concrete slab may contain ribs positioned at the slab's edges, thereby increasing the thickness of its side surfaces and allowing a portion of said lower surface of said body of concrete to be elevated.

In some embodiments, one or more edges of the upper surface of the body of concrete are sloped. When the edges are sloped, they may have a typical pitch of a one-half inch decrease in height over a six inch horizontal area.

In addition, in some embodiments the precast concrete slab further comprises a plurality of strands disposed within the body of concrete. In certain embodiments, the strands are prestressed.

Furthermore, in certain embodiments of the precast concrete slabs, the frame connecting means comprises a U-clip. The securing means comprises a lift lag in still other embodiments.

The present invention also contemplates a method of joining together precast concrete slabs, comprising the steps of: (a) providing: (i) a joining means capable of joining precast concrete slabs together, and (ii) two or more precast concrete slabs, each of the precast concrete slabs comprising a portable body of concrete and an upper surface, a lower surface, and side surfaces, and a plurality of expanded coil inserts extending inward from the side surfaces to allow side-to-side joining of the precast concrete slabs when the side surfaces of the slabs are aligned; and (b) connecting the joining means to the expanded coil inserts, thereby joining together the precast concrete slabs.

The present invention contemplates several different joining means. In different embodiments, the joining means alternatively comprise a connecting plate, a clip, a receiving plate, a plurality of eyebolts and a turnbuckle, a double-threaded rod, and a slotted-plate clip.

Finally, the present invention contemplates a method of joining together a plurality of precast concrete slabs, comprising the steps of: (a) providing: (i) two or more precast concrete slabs, each of the slabs comprising a portable body of concrete and an upper surface, a lower surface, and side surfaces, (ii) a plurality of conduits disposed within the precast concrete slabs, the conduits being positioned to allow joining of the slabs to one another when the side surfaces of the slabs are aligned, and (iii) a joining device capable of joining together a plurality of slabs, the joining device capable of being disposed within the conduits; and (b) connecting the joining device to the plurality of slabs, thereby joining together the plurality of slabs. In some embodiments, the joining device comprises a cable.

DEFINITIONS

The term "structure" refers to all types of buildings, whether or not fully enclosed by walls or a roof. The term encompasses both permanent buildings and temporary buildings. Temporary buildings may be portable (i.e., the entire building can be moved) and/or may be disassembled into their component pieces.

The term "portable" indicates the object is capable of being carried from one location to another by means such as trucks and forklifts and the like. In this sense, a "portable structure" is temporary (e.g., a portable storage facility).

The term "precast" refers to an element that is formed by casting in a form or mold at a location other than the location where the element is used for construction and thus at a time prior to its actual use.

The term "expanded coil insert" refers to a device generally used in the concrete construction industry for the lifting and handling of concrete elements. The device, which extends from a surface inward so as to be embedded into precast concrete elements, is internally threaded to allow engagement of a bolt of a suitable diameter. The present invention uses expanded coil inserts in a different manner than that of the construction industry. In the present invention, the device is used to join together precast concrete elements and to secure a structure to the precast concrete slabs.

The term "frame" refers to the elements of a building that give it shape or strength (e.g., beams). The walls and roof of a building are erected on the frame.

The term "lift lag" refers to a threaded bolt typically employed to anchor the lifting fixtures used to lift and handle precast concrete elements. According to the present invention, a lift lag is also used to secure other elements to the precast concrete slabs, including elements involved in the structure of a building constructed on the slabs, elements used to anchor the slabs to the ground, and elements used to join several slabs together. A lift lag typically is inserted through a bracket or similar device, then bolted into a receptacle like an expanded coil insert.

The term "U-clip" refers to a bracket possessing a shape similar to the letter "U." A U-clip is fastened to the concrete slab by a lift lag or comparable device, thereby providing a means of attaching other elements to the concrete slab.

The term "frame connecting means" refers to hardware capable of being secured to both a frame and to a concrete slab. For example, the frame connecting means may be a U-clip attached to both the concrete slab and the frame, thereby connecting the two together.

The term "securing means" refers to hardware capable of securing a frame connecting means to a concrete slab. To illustrate, a securing means may be a lift lag that first engages a U-clip and then screws into an expanded coil insert embedded into the concrete slab.

The term "vertical beam" refers to a component that may be utilized in the frame of a structure. Vertical beams are frequently composed of wood or a metal, such as steel, but may be composed of any other material that is suitable for its function.

The term "anchoring means" refers to components that may be used to securely anchor a concrete slab of the present invention to the underlying ground. The upper part of the anchoring means is fastened to the concrete slab, and the lower part of the anchoring means is embedded in the ground.

The terms "pipe" and "wings" refer to components of one embodiment of an anchoring means. In general, the "pipe" is a cylindrical element with a hollow core (i.e., a piece of pipe); its top end can be fastened to the concrete slab by any suitable means (e.g., a cable) and its bottom end protrudes downward into the ground. The wings may be produced from a piece of pipe, with a diameter larger than that of the "pipe" , cut lengthwise into two evenly-sized pieces. The wings are pivotally connected to the exterior surface of the "pipe" such that they can separate when the "pipe" is pulled up from the ground a short distance; this separating serves to firmly embed the anchoring means in the underlying ground.

The term "storage facility" refers to any of a number of buildings or structures that may be used to store personal property. The storage facilities generally possess four sides, three of which are enclosed and the fourth having a means of accessing the interior of the storage facility.

The term "edges" refers to the regions of the slabs where two sides come together. Thus, to illustrate, edges are formed where the top, horizontal surface of a slab ends, and the vertical side surfaces begin.

The term "pitch" refers to a downward slant or slope. The extent of the slant or slope can be defined in terms of the decrease in height that occurs over a particular horizontal area.

The term "strand" refers to a cable, generally made of steel, that may be disposed in the body of a concrete slab. The strand is placed in the slab's form at the time of casting and acts to strengthen the slab after the slab has cured.

The term "prestressed" refers to an object that is stretched and stressed prior to being put to its intended use. The object may be a strand disposed in a concrete slab, where pressure has been applied to the strand prior to pouring the cement that will ultimately form the concrete slab.

The term "ribs" refers to elongated ridges or protrusions that, according to the present invention, may be positioned on the lower surface of the portable precast concrete slabs. In a preferred embodiment, the ribs are positioned along each edge of the lower surface, thereby increasing the thickness of the slab's sides and allowing a portion of the lower surface of the slab to be elevated.

The term "joining means" includes all types of mechanisms that can be used to join two or more concrete slabs together. Generally, the joining means allow side-to-side joining of the precast concrete slabs when the side surfaces of the slabs are aligned. The joining means might be mounted on the exterior of the concrete slabs, on the interior of the slabs, or a combination of both.

The term "connecting plate" refers to a plate that simultaneously connects to two or more concrete slabs, thereby securing the slabs together. The connecting plates, generally made of steel, are generally secured to adjacent slabs by bolts. In some embodiments, the connecting plates are used to connect the sides of two adjacent slabs together. In other embodiments, the connecting plates are mounted on the top surfaces of adjacent slabs and used to connect two or more slabs to one another.

The term "clip" refers to any of a variety of devices used to join several concrete slabs. In one embodiment contemplated by the present invention, a clip is configured to snugly fit over bolts secured in the side surfaces of adjacent concrete slabs, thereby securely holding the slabs together.

The term "conduits" refers to channels within the precast concrete slabs. The conduits may traverse either the entire width of the slab or the entire length of the slab. The conduits that traverse the slab's width are distinct from those that traverse its length; that is, the conduits that traverse the width are positioned at a different height within the slab so that they do not intersect with the conduits that traverse the length. The conduits are of a size to allow a cable or the like to be inserted through them.

The term "eyebolt" refers to a bolt that is threaded on one end and looped on the other end, thereby creating an "eye" on the looped end.

The term "turnbuckle" refers to a device that allows two or more eyebolts or the like to be fastened and tightened together.

The term "double-threaded rod" refers to a slender bar with two ends, each end being threaded to allow it to be screwed into an expanded coil insert or the like.

The term "receiving plate" refers to a plate that has one or more openings configured and positioned to allow the plate to receive one or more protruding bolts or the like of an adjacent slab. In some embodiments, a small plate is used containing a single receiving opening, whereas other embodiments contemplate the use of larger slotted plates containing multiple receiving openings.

The term "slotted-plate clip" refers to a plate that has two or more slots positioned to allow the plate to engage protruding bolts or the like on adjacent concrete slabs.

The term "support" refers to an element, usually a precast concrete element, that is used in some embodiments of the present invention to secure a building's vertical wall structure. The supports may have protruding bolts to which the wall structure is secured. The supports are generally used in conjunction with specially-shaped concrete slabs.

The term "notched precast concrete slab" refers to an embodiment of a precast concrete slab wherein there is a cut-out at one or more corners of the slab. A support may be positioned in each cut-out. In this manner, the combination of the notched precast concrete slab and the supports is rectangularly shaped.

DESCRIPTION OF THE INVENTION

The present invention relates to portable construction materials and particularly to portable precast concrete slabs for use as floors for storage facilities and other types of buildings. The description of the invention is divided into three parts: I) The Characteristics Of The Precast Concrete Slabs; II) Erecting The Building Structure; and III) Joining Of Precast Concrete Slabs.

I. The Characteristics Of The Precast Concrete Slabs

Figure 1:
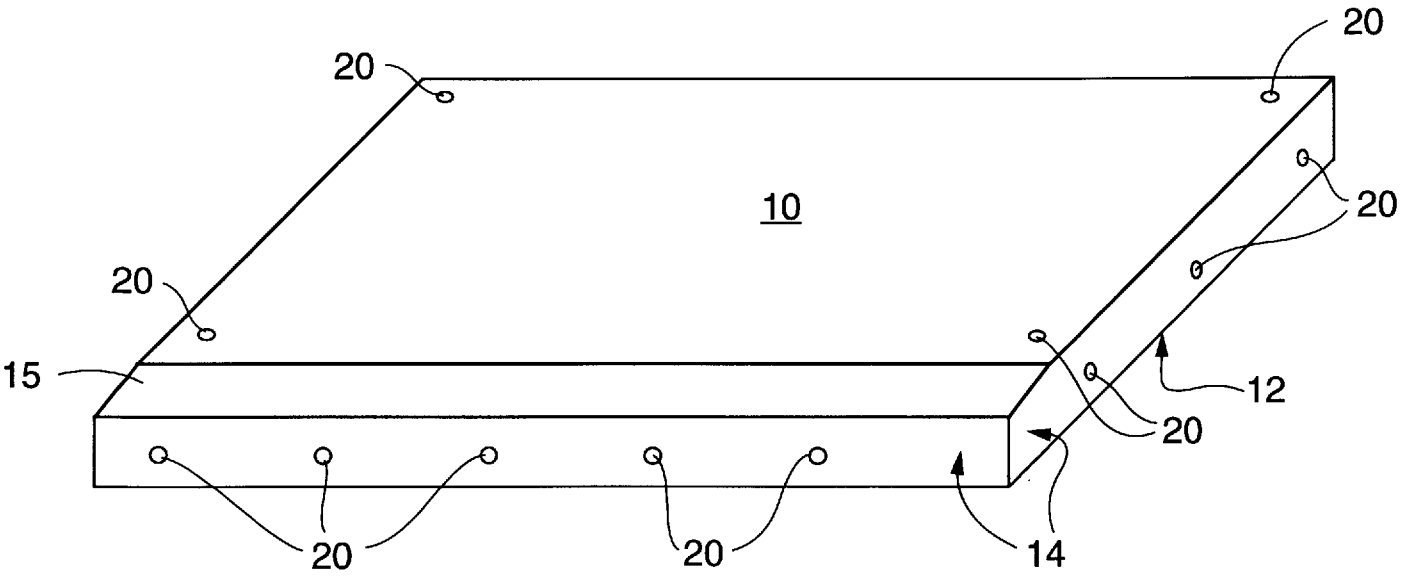
FIG. 1 is a perspective view of one embodiment of the present invention in which one edge of the concrete slab is sloped to allow for water runoff. The figure also indicates one possible configuration for the placement of the securing elements, which may be expanded coil inserts.

The present invention contemplates rectangular-shaped slabs with an upper surface 10, a lower surface 12, and four sides 14 (FIG. 1). More specifically, the present invention contemplates portable precast concrete slabs approximately 8 feet wide by approximately 20 feet long. Though the thickness, or height, of the sides 14 of the slabs varies depending on the embodiment, the preferred embodiments utilize a thickness ranging from 3 to 6 inches. However, portable concrete slabs of other dimensions are within the scope of the present invention. The actual dimensions of a particular slab will likely depend on the function for which the slab is used and the requirements of the local building code. The slabs are designed to be handled by a forklift possessing forks positioned approximately ten feet apart.

The present invention contemplates that the use of the concrete slabs may be in conjunction with a support underlying the lower surface 12. Sufficient support may be obtained by merely placing the lower surface 12 on a suitable flat, even area of ground. However, the lower surface 12 of the slab may also be placed upon a material like asphalt, crushed rock, or pressurized wood. An embodiment encompassing placement on one of these materials may be superior for several reasons. First, the materials may be used to create a relatively flat support for the concrete slabs, increasing the slabs' stability. Second, placement on such materials elevates the concrete slabs off the ground; this may help to assure that rainwater and the like flows around or under the slabs.

Figure 2:
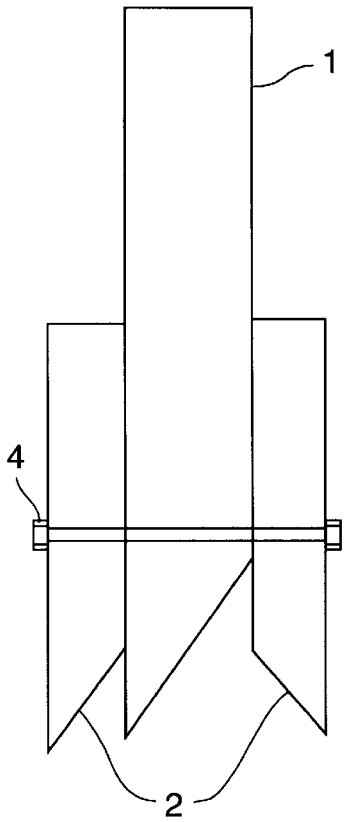
FIG. 2 is a side elevation of an anchoring means of the present invention which can be used to anchor a concrete slab to the underlying ground.

It may be desirable under certain circumstances to ensure that the concrete slabs are securely anchored to the underlying ground. FIG. 2 depicts the components of one embodiment of a pipe anchoring system according to the present invention. The primary components of the system are a main piece of pipe I approximately four feet in length and two inches in diameter and two wings 2. The two wings 2 are derived from a piece of pipe about 18 inches in length and 2 ½ inches in diameter; the two wings 2 are produced by cutting the 18-inch piece of pipe in half lengthwise. As depicted in FIG. 2, the two wings 2 are affixed to the main piece of pipe 1 at its very bottom and on either side of it by a bolting mechanism 4. Because the two wings 2 are produced from a piece of pipe with a diameter larger than that of the main piece of pipe 1, the wings 2 will fit over the rounded surface of the main pipe 1.

As is evident from FIG. 2, the bottoms of the pipe 1 and the wings 2 have a sharp angle; this angle makes it easier to drive the pipe 1 and the wings 2 into the ground. The aforementioned bolting mechanism 4 that secures the wings 2 to the pipe 1 assures that those components move into the ground as a unit. Essentially, the pipe 1 is driven deep enough into the ground so that the shorter wings 2 are completely underground. After the unit consisting of the pipe 1 and the wings 2 has been driven into the ground to a desired depth, the pipe 1 is pulled up a short distance. As the pipe 1 is pulled up, the bolting mechanism 4 allows the wings 2 to separate due to the pressure exerted by the surrounding dirt; in this manner, the wings 2 become firmly embedded in the ground. Following the anchoring of the pipe 1 and the wings 2 unit, a concrete slab can be fastened to the pipe 1, the top end of which remains above ground, by any suitable method. Alternatively, the anchoring mechanism may be placed in a hole dug in the ground and then covered with dirt or other material to secure the mechanism. The pipe 1 and the wings 2 may be constructed of any durable material, such as steel or polyvinyl chloride.

Figure 4:
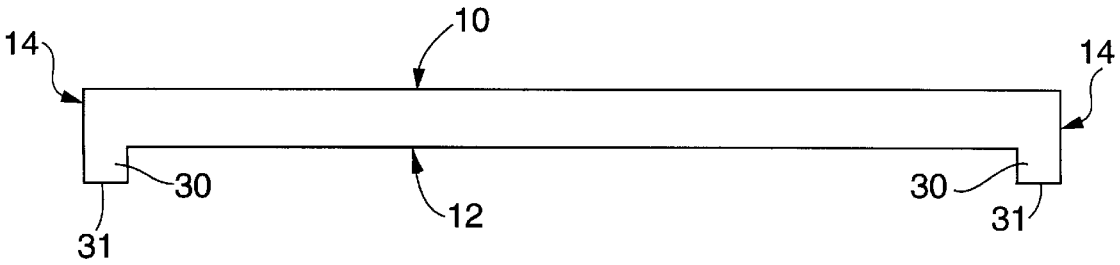
FIG. 4 is a cross-sectional side view through the middle of the slab of an alternative embodiment of a concrete slab according to the present invention.

The present invention contemplates the production of portable concrete slabs in a number of different ways. As previously noted, the sides 14 of the concrete slabs may possess differing thicknesses; the thickness can affect the strength, weight, and cost of the concrete slabs. In addition, as shown in the cross-section of an alternate embodiment in FIG. 4, the concrete slabs may have ribs or protrusions 30 that traverse the entire length and/or width of the concrete slab along the edges of its lower surface 12. The base 31 of these ribs 30 is about 6 inches, whereas the ribs 30 add about 3 inches to the thickness of the sides 14. In such embodiments, a portion of the lower surface is elevated off the ground, which may assist in water drainage or may be advantageous if the ground is uneven.

As indicated in FIG. 1, the concrete slabs of the present invention may possess one or more sloped edges 15 on their upper surface 10 to facilitate water drainage from the upper surface 10. A sloped edge 15 has a typical pitch of a one-half inch decrease in height over a six inch horizontal area.

Figure 3:
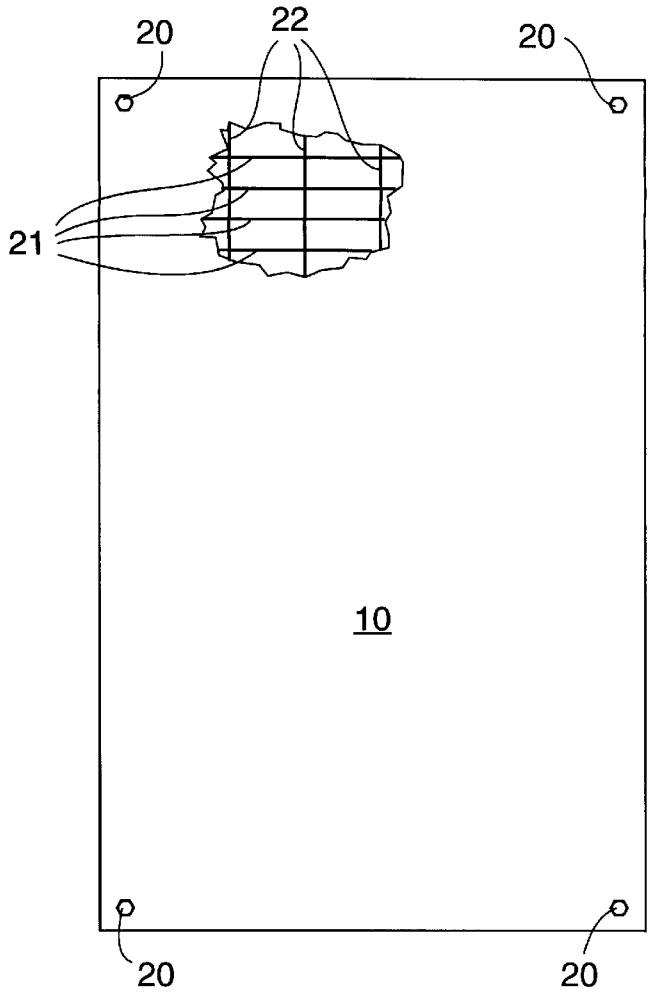
FIG. 3 is a top plan view of the steel reinforcement present in one embodiment of the present invention.

The portable precast concrete slabs contain steel reinforcement. FIG. 3 illustrates the steel reinforcement in one embodiment of the present invention. Longitudinal steel reinforcement entails #3 steel reinforcement rods 22 placed at 12-inch intervals; transverse steel reinforcement entails #4 steel reinforcement rods 21 placed at 6-inch intervals. Of course, other arrangements of steel reinforcement can easily by envisioned and are within the scope of the present invention.

In a preferred embodiment, the concrete is prestressed. This feature provides strength against the pressures associated with twisting and turning encountered when a slab is handled and set down. A preferred method of prestressing entails placing a number (e.g., ten) of strands of steel cable (e.g., ½ inch in diameter) in the slab's form before casting; the strands are long enough to protrude from the ends of the form and to be secured to an upright situated outside the form. Prior to pouring the cement into the form, approximately 30,000 pounds of pressure are applied to the strands, thereby stretching them. After the cement has cured (e.g., heat cured), the ends of the strands are cut. The resulting precast concrete slabs may "bow" slightly due to the release of pressure when the end portions of the strands are removed.

II. Erecting The Building Structure

The present invention also contemplates a method to allow the wall structure of the storage facility or similar building to be erected on the portable concrete slab. The method of erecting is designed to assure both that the wall structure may be easily and securely erected on the concrete slab and that the wall structure may be readily disassembled if need be. As previously noted, currently available portable storage facilities do not provide for a portable concrete slab; instead, these other storage facilities either employ a prefabricated floor made of a material other than concrete or are constructed on a concrete slab poured at the building site itself.

The method of erecting contemplated by the present invention entails the use of securing elements 20, in the shape of cylindrical inserts, embedded into the concrete slabs at the time of casting the concrete. Inserts like the expanded coil inserts used for lifting and handling concrete elements are preferred (FIG. 5); however, the present invention uses such inserts for the attachment of the building structure rather than for lifting. The design of such inserts serves to distribute the stress created by the building structure over a large area of concrete. Expanded coil inserts like the Dayton Superior F-57 NC Expanded Coil Insert (not shown) [Dayton Superior Corporation; Houston, Tex.] or the Richmond ¾" Type EC-2 Insert (not shown) [Richmond Precast Concrete Products, Inc.; Richmond, Va.] may be used in the current invention; the dimensions of these two inserts are approximately 4½ inches in length by 2 inches in width. Manufacturer data indicates that these expanded coil inserts have a safe working load tension of 4,250 pounds or greater when the inserts are embedded with a minimum edge distance of 6 inches.

In essence, the securing elements 20 provide a receptacle for bolting the building's wall structure to the precast concrete slab. The securing elements 20 should be embedded into the concrete in each area where an upright beam or similar support may be placed. Thus, the securing elements 20 may be embedded in the four corners of the upper surface 10 of portable precast concrete slabs.

Figure 5:
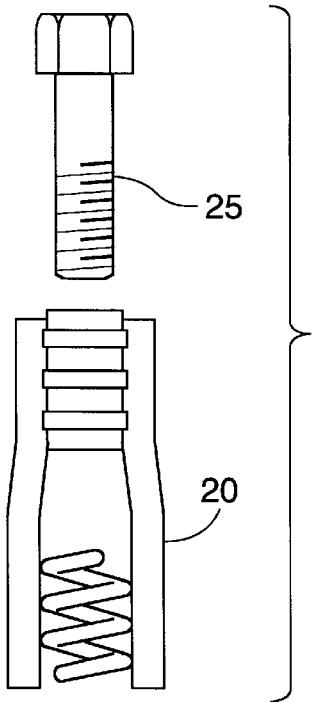
FIG. 5 is a side elevation of an expanded coil insert of the type embedded into a concrete slab of the present invention, and showing how a bolt may engage the expanded coil insert.
Figure 6:
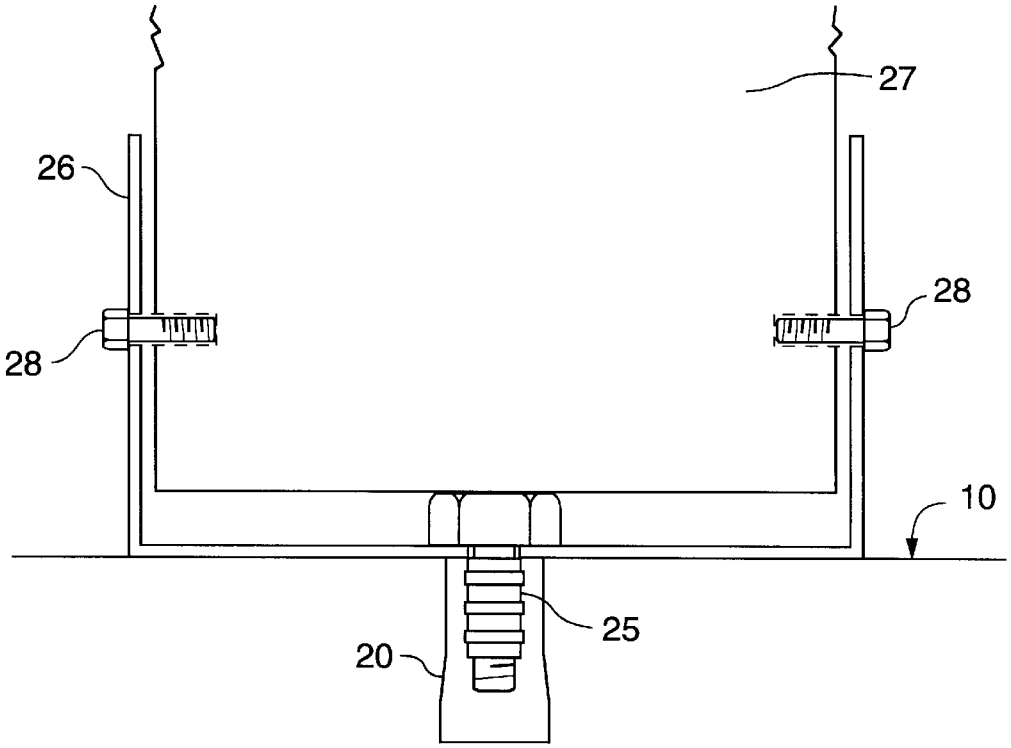
FIG. 6 is a cross-sectional view of a method in which a vertical beam or support may be secured to the top surface of a concrete slab of the present invention.

Other hardware normally associated with the lifting and handling of concrete elements is employed with the embedded securing elements 20 to fasten the building's frame structure to the portable concrete slab. As indicated in FIGS. 5 and 6, a lift lag, bolting device, or comparable securing means 25 can be used to bolt a U-clip or similar frame connecting means 26 into the securing element 20 embedded in the concrete slab; a Richmond Lift Lag 8/66, for example, is suitable for this purpose. FIG. 6 shows how the frame of a structure 27 made out of wood, steel, or other materials is fastened to the U-clip or similar frame connecting means 26 by mounting bolts 28 or the like. Thereafter, the structure of the storage facility or other building can be constructed upon the frame of the structure 27.

The present invention also contemplates the use of specially shaped portable precast concrete slabs for large and multi-level buildings. Because of the increased stress created by such buildings, the mechanism previously described for securing the building's wall structure to the concrete slab may not provide sufficient support. As a result, a mechanism is presented that allows the wall structure to be secured to precast concrete supports rather than to the concrete slab itself; these supports are used in conjunction with the aforementioned specially shaped concrete slabs, which provide the building's floor.

Figure 15A:
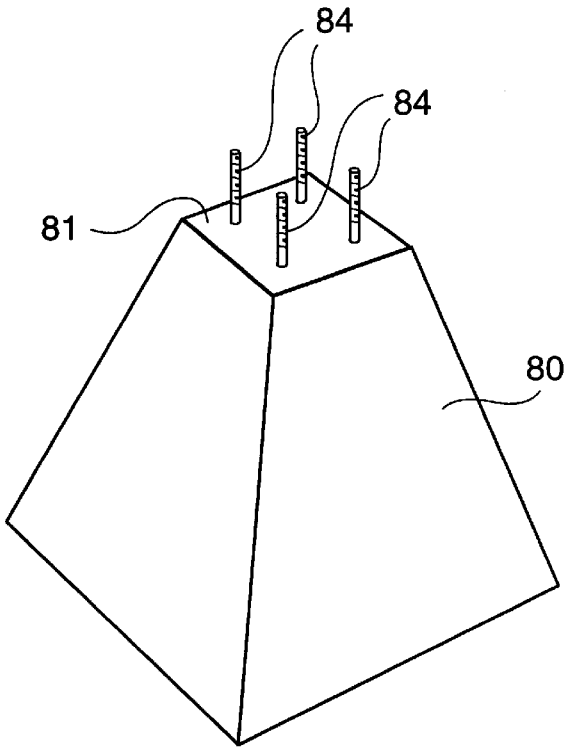
FIG. 15A is a perspective view of a precast concrete support that may be used in conjunction with a notched precast concrete slab according to one embodiment of the present invention.
Figure 15B:
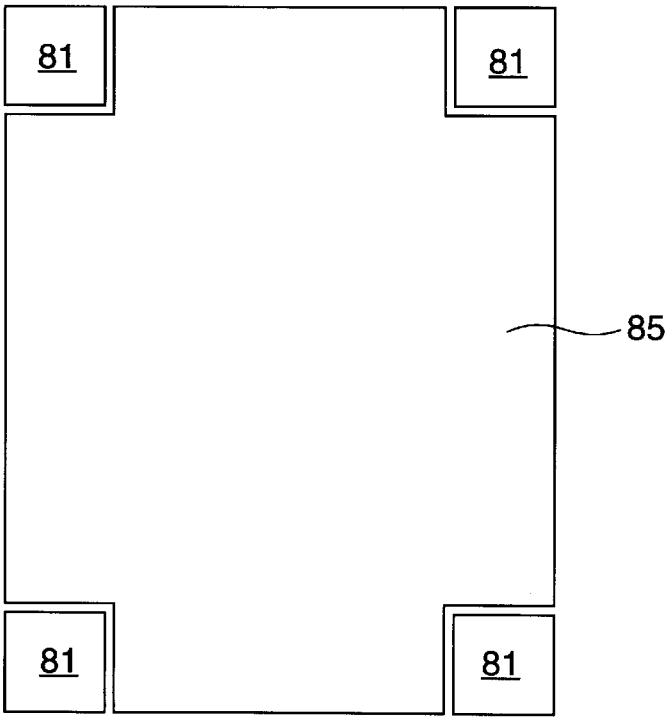
FIG. 15B is a top plan view of a notched precast concrete slab in conjunction with four precast concrete supports, one support in each corner of the slab. The threaded bolts that usually protrude vertically from the top of each support, and which allow attachment of the building's structure, are not shown in this view.

FIG. 15A depicts one potential embodiment of a support, The precast concrete supports 80 shown in FIG. 15A have a top surface 81 from which embedded threaded bolts 84 protrude. The threaded bolts 84 are used to secure the building's wall structure. The typical dimensions of the top surface 81 are twelve inches by twelve inches, but may vary. FIG. 15B indicates how the precast concrete supports 80 are used with a notched precast concrete slab 85. The notched precast concrete slab 85 is configured to accommodate the top surface 81 of the precast concrete supports 80. Thus, the notched precast concrete slabs 85 may have twelve inch by twelve inch cut-outs at each corner where the precast concrete supports 80 are positioned. Though the building's wall structure is secured to supports rather than to the concrete slabs themselves, there is an integrated unit of concrete slabs and supports.

Many different types of materials (not shown) can be used in the construction of the wall structure of storage facilities or similar small buildings. Traditional materials like metal sheeting or wood siding may be attached to the frame of the structure 27. These materials may be used by themselves or in conjunction with other materials. For example, Great Dane offers a high-density urethane foam designed for use in trailers utilized in the transportation of goods. This composite material may be bonded to a durable external material like aluminum, thus forming a thermal-efficient unitized structure.

III. Joining Of Precast Concrete Slabs

Figure 7:
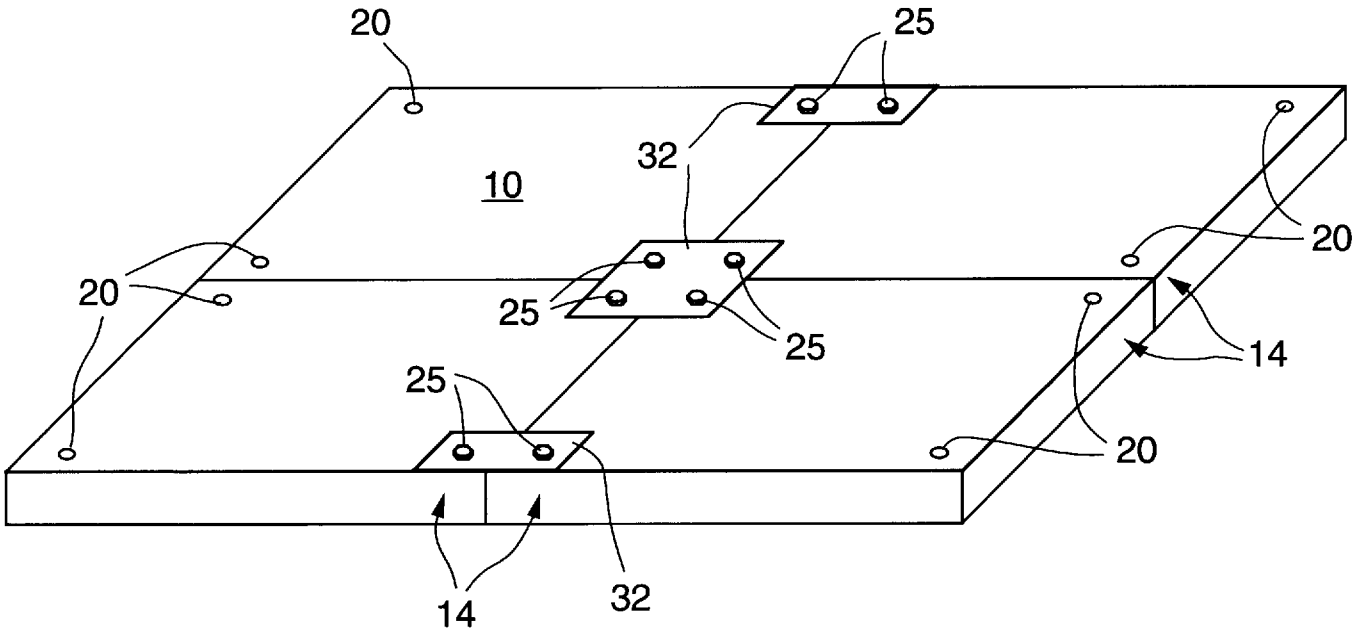
FIG. 7 is a perspective view depicting the use of connecting plates, mounted on the upper surface of the slabs, to join several concrete slabs according to the present invention.

The invention contemplates the joining of multiple portable precast concrete slabs to one another. As such, the invention provides great flexibility regarding the configuration of the building ultimately created. For instance, FIG. 7 depicts four concrete slabs connected to create an area roughly 16 feet in width and 40 feet in length. The concrete slabs may also be joined side-to-side in order to create a long concrete strip; this arrangement is frequently used in self-storage facilities. Other configurations can also be created.

The invention contemplates several different types of joining means for joining the concrete slabs together. These methods are now presented in the form of Examples.

EXAMPLE 1

Alternative Joining Means: Top-Mounted Connection Plate

This embodiment entails the use of securing elements 20 analogous to those used to secure a building structure to the concrete slab. However, the present invention contemplates that different individual securing elements 20 will be used with the connecting plates 32 than those used to secure the building's structure to the concrete slab. As illustrated in FIG. 7, which shows four connected concrete slabs, connecting plates 32 mounted on the upper surface 10 of the concrete slabs may be bolted into the securing elements 20 (not shown) of adjoining slabs.

In this embodiment, the securing elements 20 are comprised of Dayton Superior F-57 Expanded Coil Inserts or similar; the expanded coil inserts must be embedded into the slabs at least 6 inches from the edges in order to prevent spalling of the concrete slabs. A bolting device 25 of ¾ inch diameter engages a hole in the connecting plate 32 and bolts into the Dayton Superior F-57 Expanded Coil Inserts.

The connecting plates 32 are generally made of steel, and their dimensions differ depending on how they are used. When the connecting plates 32 are used to connect four slabs together, they are approximately 14 inches in both width and length, and ⅛ inch in thickness; four bolting devices 25 are used in this configuration, each securing the connecting plate 32 into a different slab. When the connecting plates 32 are used to connect two slabs together, they are approximately 6 inches in width, 14 inches in length, and ⅛ inch in thickness; two bolting devices 25 are used in this configuration, each securing the connecting plate 32 into one of the two slabs.

EXAMPLE 2

Alternative Joining Means: Side-Mounted Connection Plate

Figure 8:
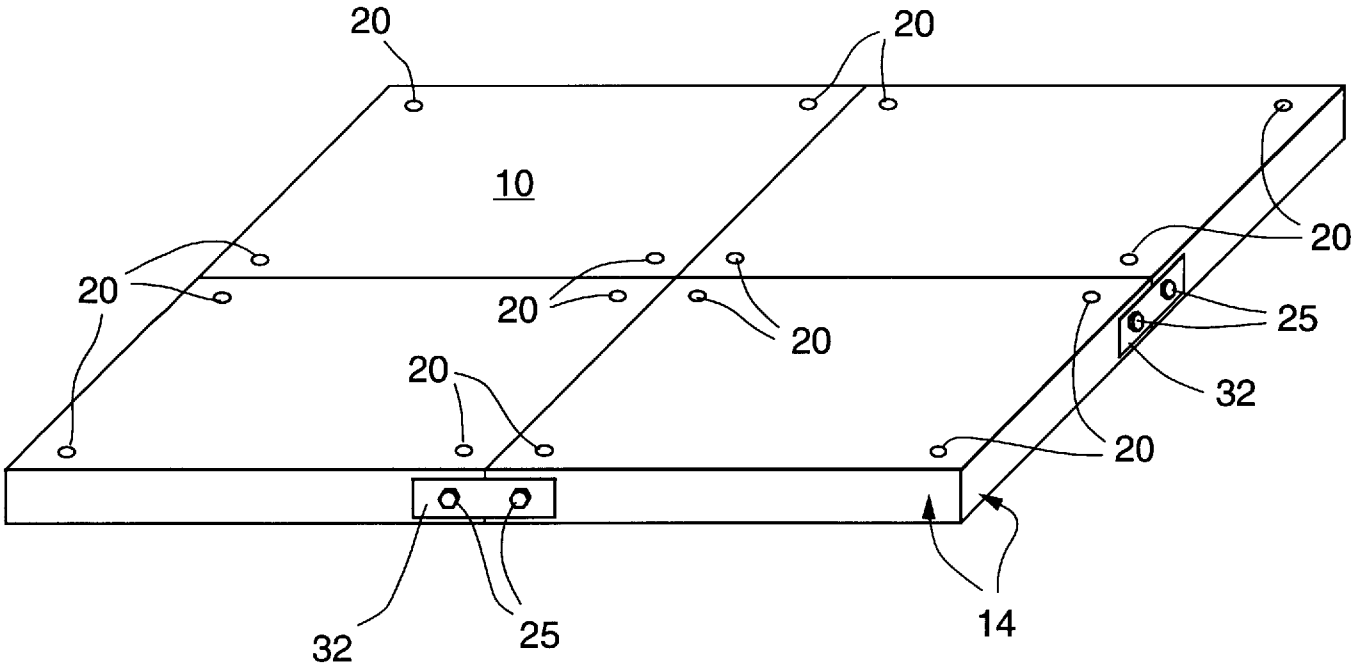
FIG. 8 is a perspective view depicting the use of connecting plates, mounted on the slab's sides, to secure join several concrete slabs according to the present invention.

This embodiment is similar to that in Example 1 in that it uses connecting plates 32 to secure the precast concrete slabs together. However, the securing elements 20 used to secure adjacent slabs together exit from the sides 14 of the slabs, as depicted in FIG. 8. This allows the use of connecting plates 32 mounted on the sides 14, rather than the upper surface 10, of the concrete slabs. However, it should be noted that the present invention preferably affixes the building's structure to the top surface 10 of the slabs. Therefore, when side-mounted connecting plates 32 are used, securing elements 20 will also be present on the upper surface 10 of the concrete slabs to accommodate the hardware used to secure the building's structure to the slab.

FIG. 8 illustrates four connected concrete slabs. The same mechanism used to fasten the top-mounted connecting plates 32 to the concrete slabs may be used in this embodiment. However, only two slabs are fastened together by each side-mounted connecting plates 32. The width of the connecting plates 32 must be less than or equal to that of the thickness of the slabs' sides 14.

EXAMPLE 3

Alternative Joining Means: Conduit With Cable

Figure 9A:
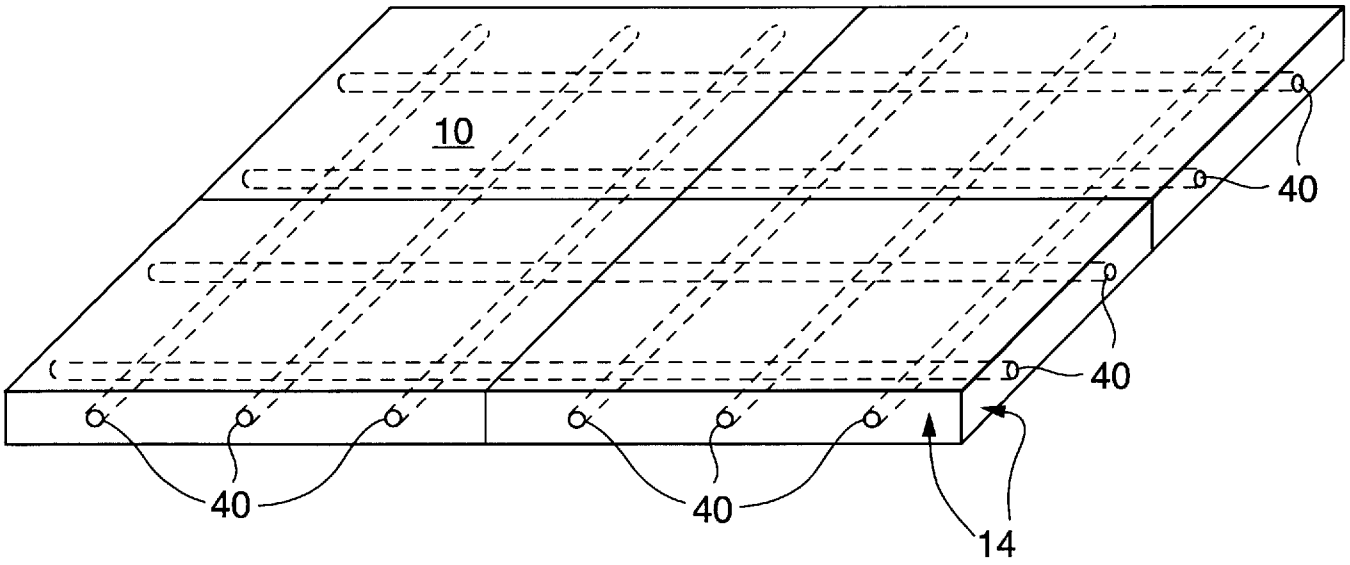
FIG. 9A is a perspective view showing a conduit system in which cables can be placed to join several concrete slabs according to the present invention.

The present invention also contemplates the joining of precast concrete slabs through the use of cables 42 disposed within conduits 40. In this embodiment, depicted in FIG. 9A, conduits (40) ½ inch in diameter may be used. For a typical slab 8 feet wide and 20 feet long, three conduits 40 may traverse the length of the concrete slabs and two conduits 40 may traverse the width; the ends of the conduits exit the sides 14 of the slabs. To prevent the conduits 40 from interfering with each other where they cross within the slab, those conduits 40 that traverse the length of the slab are embedded at a different height than those that traverse the width. The conduits 40 are embedded into the slabs at least 12 inches from the vertical edges of their sides 14; this assures that the concrete slabs are strong enough to withstand the pressure exerted by the connection system when several slabs are joined. The locations of the conduits 40 is consistent among the concrete slabs such that the conduits in adjacent slabs are aligned when the slabs themselves are aligned. This characteristic is shown in FIG. 9A, which depicts the alignment of the conduits 40 in four slabs. The conduits 40 are frequently constructed of polyvinyl chloride.

In order to secure adjacent slabs to one another in this embodiment, a cable 42 is inserted into the opening of the conduit 40 where it exits the side 14 of the slab. The cable 42 may be approximately ¼ inch in diameter. The cable 42 is fed through the aligned conduits of adjacent slabs such that it traverses the entire length or width of two (or more) adjacent slabs.

Figure 9B:
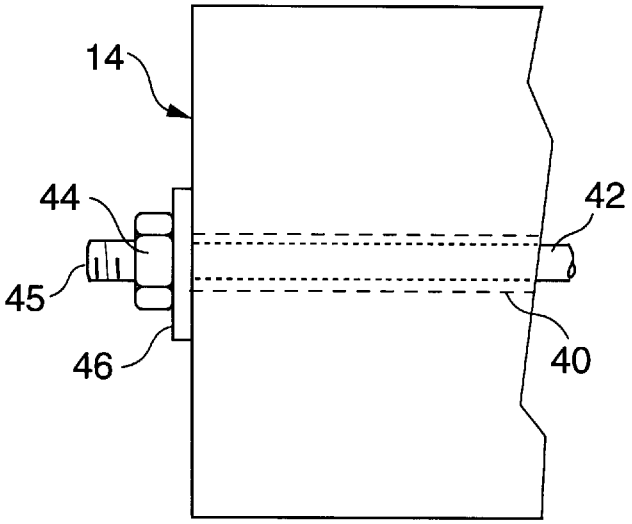
FIG. 9B is a cross-sectional view indicating how the head end of a cable that is fed through a conduit to join several concrete slabs is secured to a side of one of the slabs.
Figure 9C:
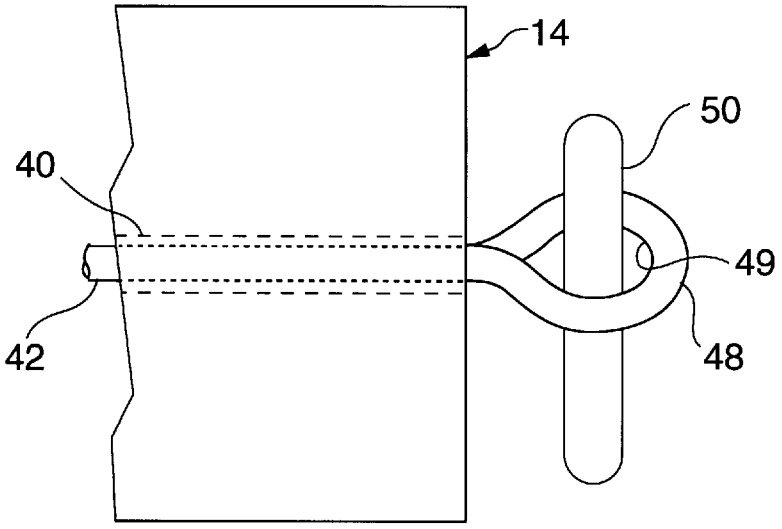
FIG. 9C is a cross-sectional view indicating how the tail end of a cable that is fed through a conduit to join several concrete slabs is secured on a side of one of the slabs.

In order to securely fasten adjacent slabs together, the cables 42 are tautly fastened at each of the two ends where they exit the sides 14 of the slabs. As depicted in FIG. 9B, a threaded cap 45 is placed over one end of the cable 42, arbitrarily termed the head end, and crimped to secure it to the head end of the cable 42. After feeding the head end of the cable 42 through the conduit 40, the head end of the cable 42 (covered by the threaded cap 45) is passed through a washer/plate 46; the threaded cap 45 is then fastened to a ¼ inch nut 44 to secure the head end of the cable 42. The washer/plate 46 prevents the nut 44 fastened to the cable's head end from entering the conduit 40. The other end of the cable 42 that exits the conduit 40 uses a different securing mechanism. As depicted in FIG. 9C, this other end, arbitrarily termed the tail end 48, is looped around and fastened tightly to the cable 42 itself at the point where it exits the side 14 of the slab; the tail end 48 thus forms a hole 49. A pin 50, typically 2 inches in length and ¾ inch in diameter, can be inserted through the hole 49, thereby securing the tail end 48 of the cable 42. Such securing of the head end and the tail end 48 ensures that adjacent slabs remain in contact with one another.

EXAMPLE 4

Alternative Joining Means: Side Clip

Figure 10A:
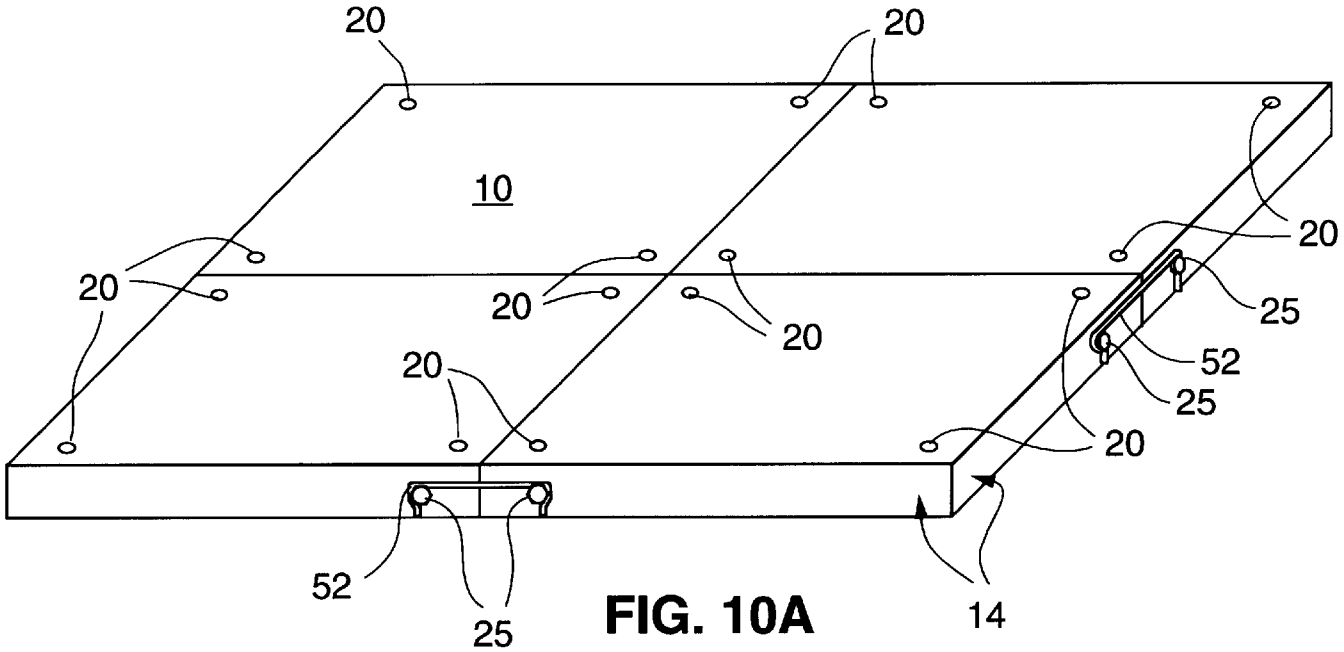
FIG. 10A is a perspective view depicting the use of side-mounted clips to join two concrete slabs according to the present invention.
Figure 10C:
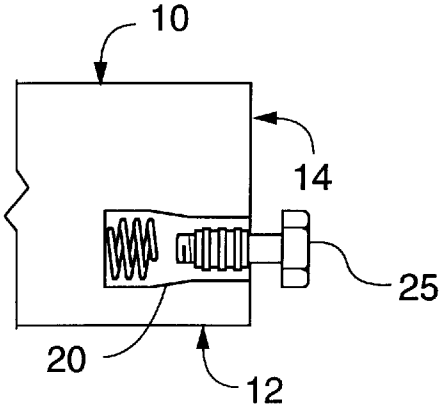
FIG. 10C is a cross-sectional view depicting a protruding bolt partially engaging a securing element embedded into a concrete slab. The protruding bolt may be used in conjunction with joining means to join two concrete slabs according to the present invention.

This embodiment resembles that set forth in Example 2 in that two adjacent concrete slabs are secured together through a side-mounted device. However, the concrete slabs in this embodiment are connected together by a side clip 52. As depicted in FIG. 10C, a securing element 20 such as a Dayton Superior F-57Expanded Coil Insert is embedded in the concrete slab and configured so that it exits the side 14 of the slab. The securing elements 20 must be embedded into the slabs at least 6 inches from the edges in order to prevent spalling of the slabs. A bolting device 25 of ¾ inch diameter is bolted part way into the securing element 20, such that there is a space of about and at least ¼ inch between the head of the bolt and the side 14 of the slab (see FIG. 10C). This same "protruding bolt" arrangement is used in other connection systems that are discussed infra.

Figure 10B:
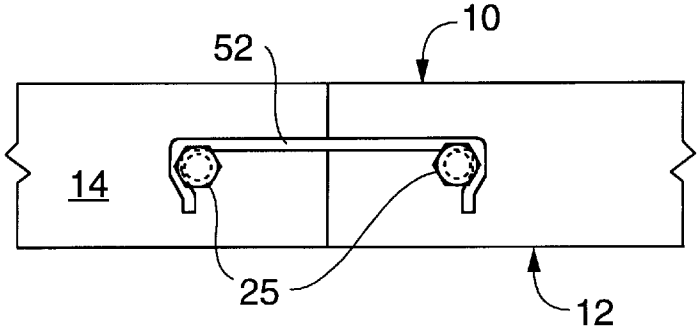
FIG. 10B is a side elevation showing how a side-mounted clip engages bolts on each of the two concrete slabs that it joins.

The side clip 52, generally made of steel, must be of a thickness that enables it to fit within the space created by the head of the bolt and the side 14 of the slab; thus a side clip 52 of approximately ¼ inch thickness is typically used. As depicted in FIGS. 10A and 10B, the side clip 52 is configured such that it can traverse the distance between bolting devices 25 of two adjacent slabs. Additionally, the side clip 52 is designed so that it holds two adjacent slabs snugly together and cannot easily be removed; FIGS. 10A and 10B show one acceptable side clip 52 design.

Figure 10D:
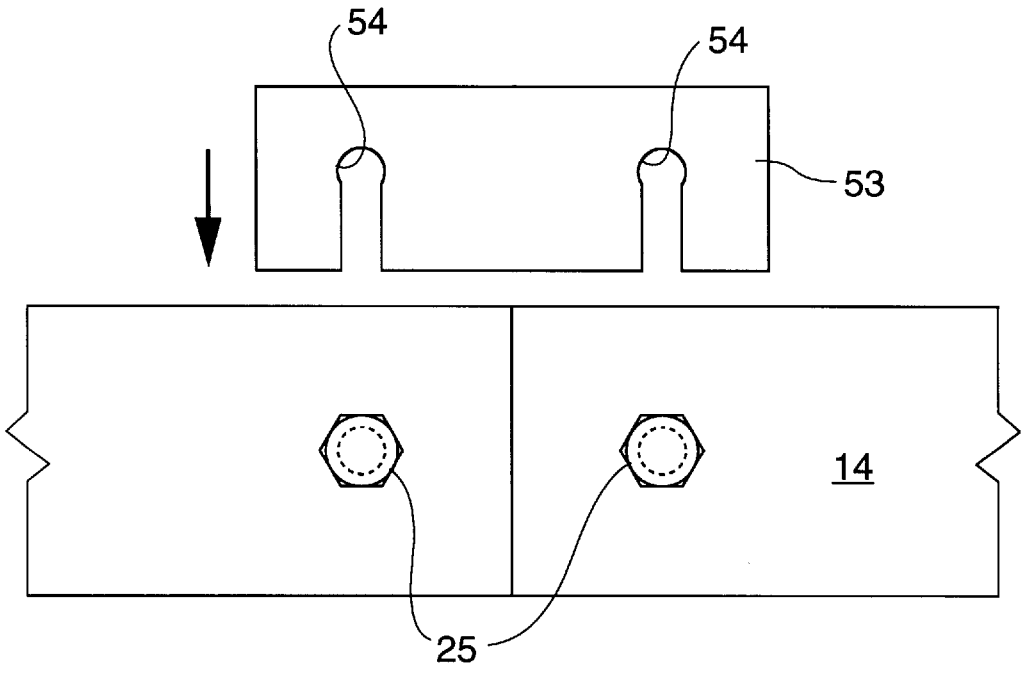
FIG. 10D is a side elevation showing how a slotted-plate clip engages bolts on each of the two concrete slabs that it joins.

FIG. 10D depicts an alternative embodiment of a side-mounted clip connection system. This embodiment also utilizes bolting devices 25 bolted part way into securing elements 20, as described above. However, a pretensioned slotted-plate clip 53 is used to secure adjacent concrete slabs together instead of the side clip 52. The slotted-plate clip 53 has two slots 54 positioned such that when they engage the bolting devices 25 of two adjacent slabs, the two slabs are brought flush with one another. The slotted-plate clip 53 is secured by hammering it over the protruding bolting devices 25 of adjacent slabs. As shown in FIG. 10D, the void at the top of slots 54 is larger than that at the base. This larger void assures that the slotted-plate clip 53 remains secure after it is hammered over the protruding bolting devices 25.

EXAMPLE 5

Alternative Joining Means: Side "Eye-Bolt" With Turnbuckle

Figure 11A:
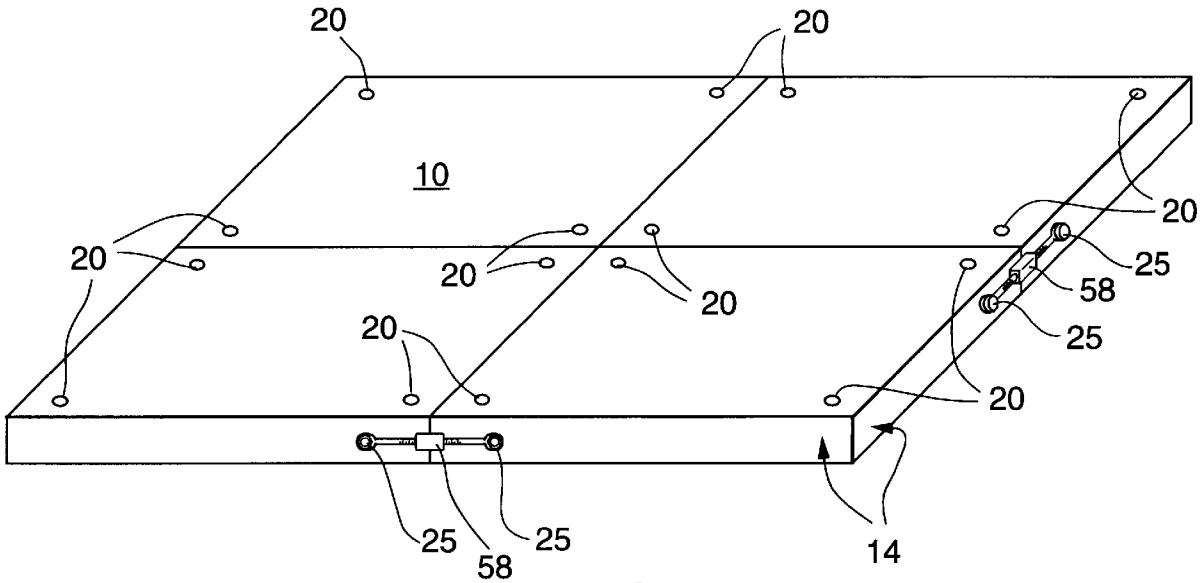
FIG. 11A is a perspective view depicting how two side-mounted eyebolts may be used with a turnbuckle in order to join two concrete slabs according to the present invention.
Figure 11B:
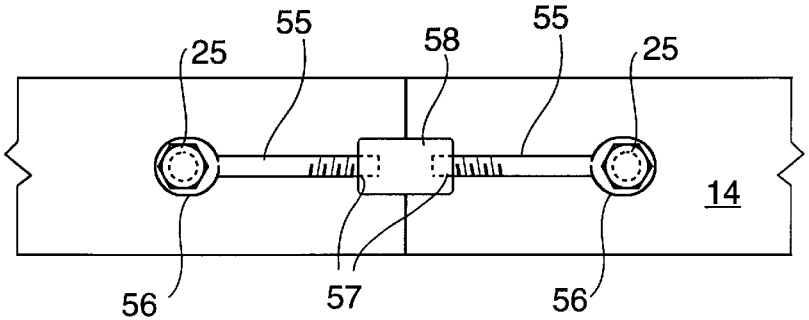
FIG. 11B is a side elevation showing in greater detail the eyebolt and turnbuckle joining means of the present invention.

This embodiment, presented in FIGS. 11A and 11B, is essentially the same as that described in Example 4 with the exception of the mechanism used to secure two adjacent concrete slabs together. That is, the securing elements (not shown) and bolting devices 25 are configured analogously to those in Example 4.

The mechanism that secures the two adjacent slabs together includes two eyebolts 55, each approximately ¼ inch in diameter, and a turnbuckle 58. Initially, the looped ends 56 of the eyebolts 55 are placed over the protruding heads of the bolting devices 25 (see FIG. 11B) of two adjacent slabs. Thereafter, the threaded ends 57 of the eyebolts 55 are engaged with the turnbuckle's screw link (not shown), and the eyebolts 55 are tightened until the securing mechanism holds the adjacent slabs snugly together.

EXAMPLE 6

Alternative Joining Means: Double-Threaded Rod

Figure 12A:
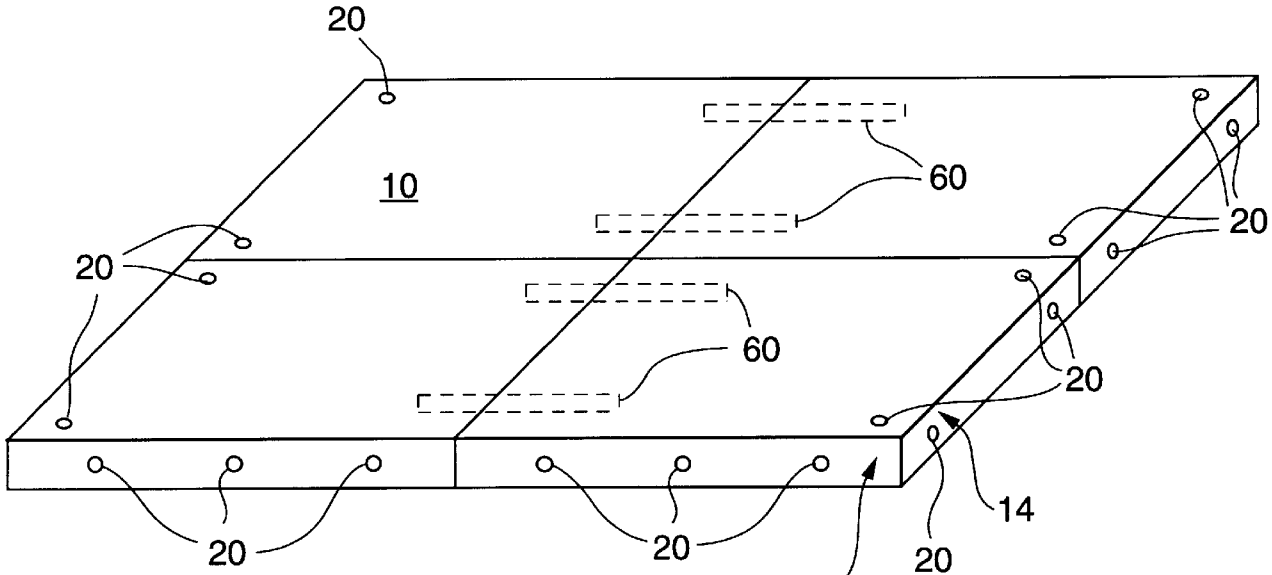
FIG. 12A is a perspective view depicting (with dashed lines) the location of double-threaded rods used to join two adjacent concrete slabs according to the present invention. Potential locations for the securing elements that the double-threaded rods insert into are also shown on the sides of the slabs.
Figure 12B:
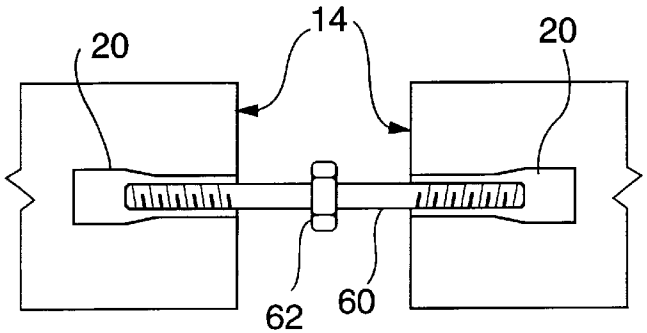
FIG. 12B is a cross-sectional view showing a double-threaded rod engaging securing elements of adjacent concrete slabs according to the double-threaded rod joining means of the present invention.

This connection system, depicted in FIGS. 12A and 12B, utilizes a double-threaded rod 60 to secure two adjacent concrete slabs together. The double-threaded rod 60 connects together the sides of two slabs that face one another; as such, this connection system differs from those previously presented where adjacent slabs are connected together by externally-mounted hardware that connects sides 14 of adjacent slabs that face in the same direction (compare FIG. 12A with, for example, FIG. 11A).

As was the case in Examples 2, 4 and 5, securing elements 20 are embedded into the concrete extending inward from the side surface of the slab. Again, a Dayton Superior F-57 Expanded Coil Insert can be used as the securing element 20. A double-threaded rod (60) ¾ inch in diameter engages the securing elements 20 present in the sides 14 of facing slabs. The double-threaded rod 60 has a hex 62 in its middle; the hex 62 is part of the solid, one-piece double-threaded rod 60. The hex 62 is needed in order to draw the facing slabs together. Essentially, a narrow wrench (not shown) engages the hex 62 and is used to turn the double-threaded rod 60 so that it can be screwed into the securing elements 20 of facing slabs. The hex 62 prevents the slabs from being brought completely flush with one another; as the hex 62 will be separating the slabs when the double-threaded rod 60 is completely threaded. Thus, it is advisable to use a double-threaded rod 60 with a very narrow hex 62 (e.g., ¼ inch in width) so that the slabs can be brought as close together as possible.

The securing elements 20 are positioned at least 12 inches from the vertical edges of their sides 14, this arrangement prevents spalling of the concrete slabs, especially when double-threaded rods 60 are placed on adjacent sides 14 of a slab near the vertical edge. For a typical slab 8 feet wide and 20 feet long, two securing elements 20 exit the shorter side, whereas three securing elements 20 exit the longer side. The locations of the securing elements 20 is consistent among the concrete slabs such that the slabs are aligned when they are connected together with a double-threaded rod 60.

EXAMPLE 7

Alternative Joining Means: Bolt Into Plate With Oblong Opening

In this embodiment, a protruding bolt from one concrete slab engages an opening in a receiving plate in a second concrete slab, thereby securing the two slabs together. The protruding bolt mechanism is the same as that described in Example 4 and depicted in FIG. 10C. Thus, a securing element 20 such as a Dayton Superior F-57 Expanded Coil Insert is embedded in the concrete slab and configured so that it exits the side 14 of the slab. A bolting device 25 of ¾ inch diameter is bolted part way into the securing element 20, such that there is a space of about ¼ inch between the head of the bolting device 25 and the side 14 of the slab (see FIG. 10C).

Figure 13A:
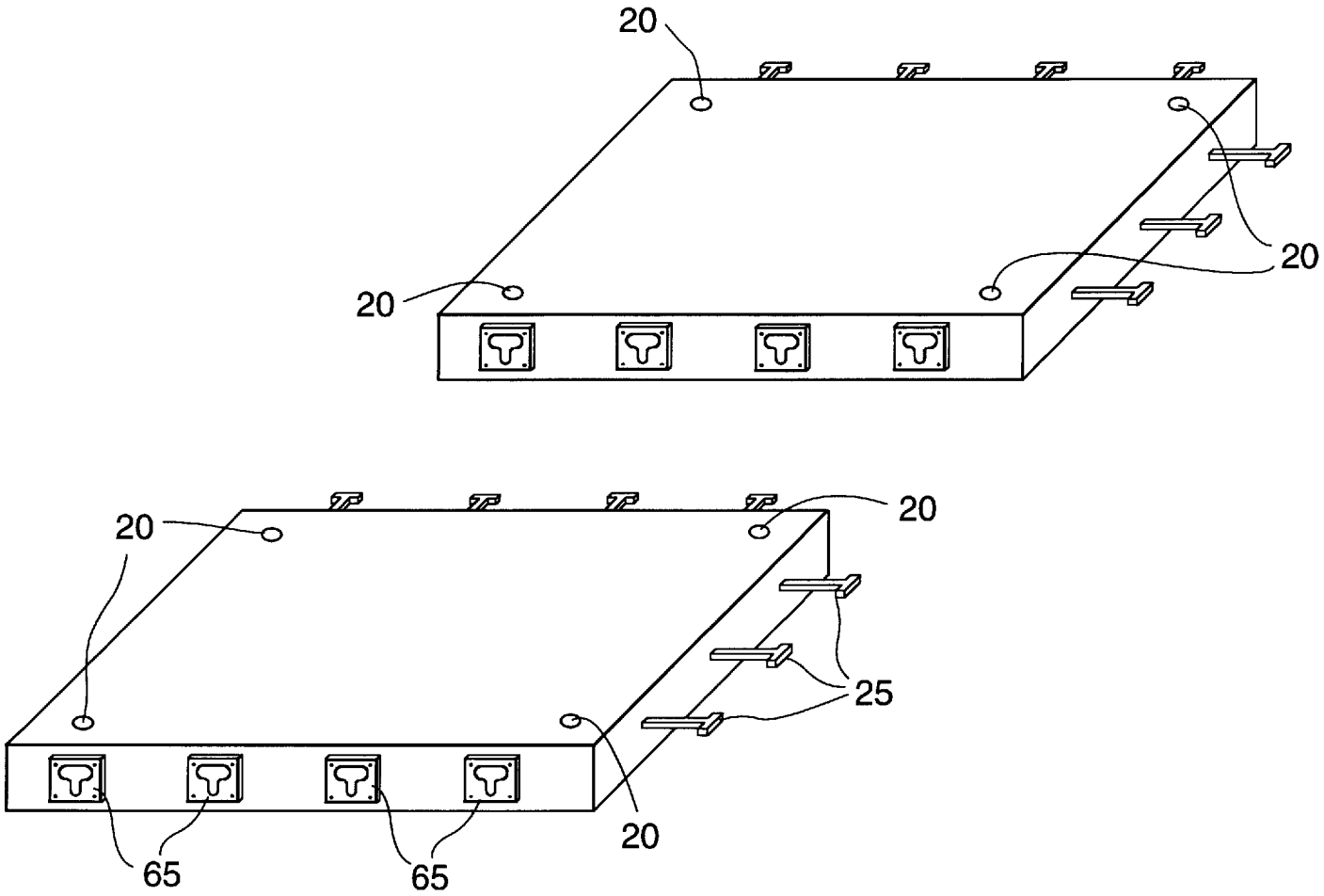
FIG. 13A is a perspective view depicting how several concrete slabs may be joined by insertion of protruding bolts of one slab (the size of the bolts being greatly exaggerated) into separate receiving plates of another slab according to the present invention.
Figure 13B:
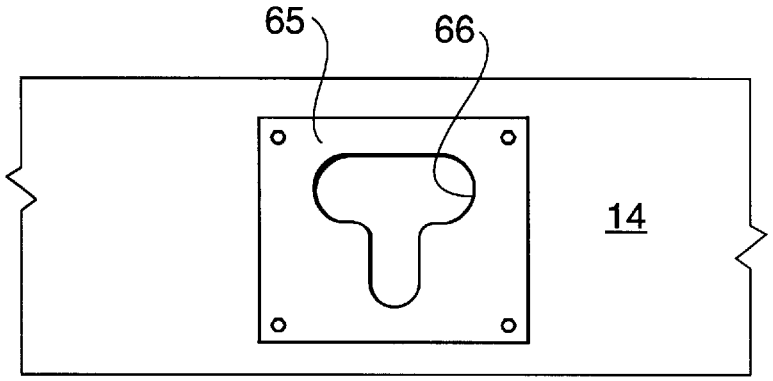
FIG. 13B is a side elevation that shows one of the plates of FIG. 13A in greater detail, especially the oblong opening into which a protruding bolt of another slab may be inserted.
Figure 13C:
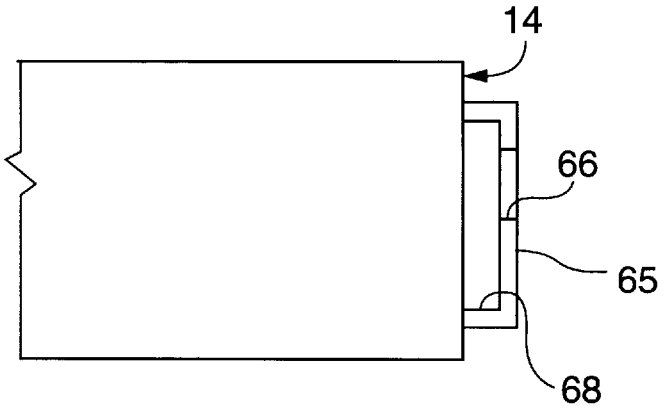
FIG. 13C is a cross-sectional view through a concrete slab and one of the plates of FIGS. 13A and 13B showing the pocket formed by the plate and the slab.

The plate 65 that receives the bolting device 25 is depicted in FIGS. 13B and 13C. The plate 65, which is 4 inches in width and in length in a preferred embodiment, is attached to the side 14 of the slab by bolts suitable for securing an object to concrete. As shown in FIG. 13B, the plate 65 has an oblong opening 66, being wider on top than on the bottom. The top of the oblong opening 66 is able to accommodate the head of the bolting device 25, whereas the narrower bottom of the oblong opening 66 is only wide enough to accommodate the ¾ inch diameter of the remainder of the bolting device 25. The walls of the plate 65 and the side 14 of the slab define a pocket 68 (see FIG. 13C). The pocket 68 is of a thickness able to receive the head of the bolting device 25. Two concrete slabs are connected by inserting the head of the bolting device 25 of one slab through the wider top portion of the oblong opening 66 of the other slab to the point where the head contacts the side 14 of the other slab. The slab with the bolting device 25 is then lowered slightly, such that the head of the bolt is secured in the pocket 68 behind the narrower portion of the oblong opening 66; in this manner, the two connected slabs are flush with one another.

FIG. 13A shows how the bolting devices 25 and plates 65 are typically arranged on each slab. For a concrete slab 20 feet long and 8 feet wide, four bolting devices 25 are placed on one of the longer sides and three bolting devices 25 are placed on one of the shorter sides. Similarly, four plates 65 are placed on the other longer side and three plates 65 are placed on the other shorter side. The bolting devices 25 and plates 65 are placed in analogous positions on different concrete slabs such that one slab can be connected to two others (see FIG. 13A). That is, the bolting devices 25 on the longer side 14 of a first slab engage the plates 65 on the longer side 14 of a second slab, and the bolting devices 25 on the shorter side 14 of the first slab engage the plates 65 on the shorter side 14 of a third slab.

EXAMPLE 8

Alternative Joining Means: Bolt Into Slotted Plate

This embodiment is analogous to that presented in Example 7 with the exception of the type of plate engaged by the bolting device 25. In this embodiment, depicted in FIGS. 14A and 14B, a slotted plate 70 that covers nearly the entire side 14 of the slab is substituted for the 4-inch square plates used in the embodiment described in Example 7.

The slotted plate 70 is secured to the side 14 of the slab by a mechanism that utilizes elements previously described. Specifically, a securing element (not shown) like a Dayton Superior F-57 Expanded Coil Insert is embedded in the concrete slab. A bolting device 25 of ¾ inch diameter engages the slotted plate 70 and then is bolted into the securing element, thereby attaching the slotted plate 70 to the side 14 of the slab. The slotted plate 70 that covers the longer sides (i.e., 20 feet) of slabs is generally attached in three locations, whereas the slotted plate 70 that covers the shorter sides (i.e, 8 feet) is generally attached in two locations (see FIG. 14A).

Figures 14A, 14B:
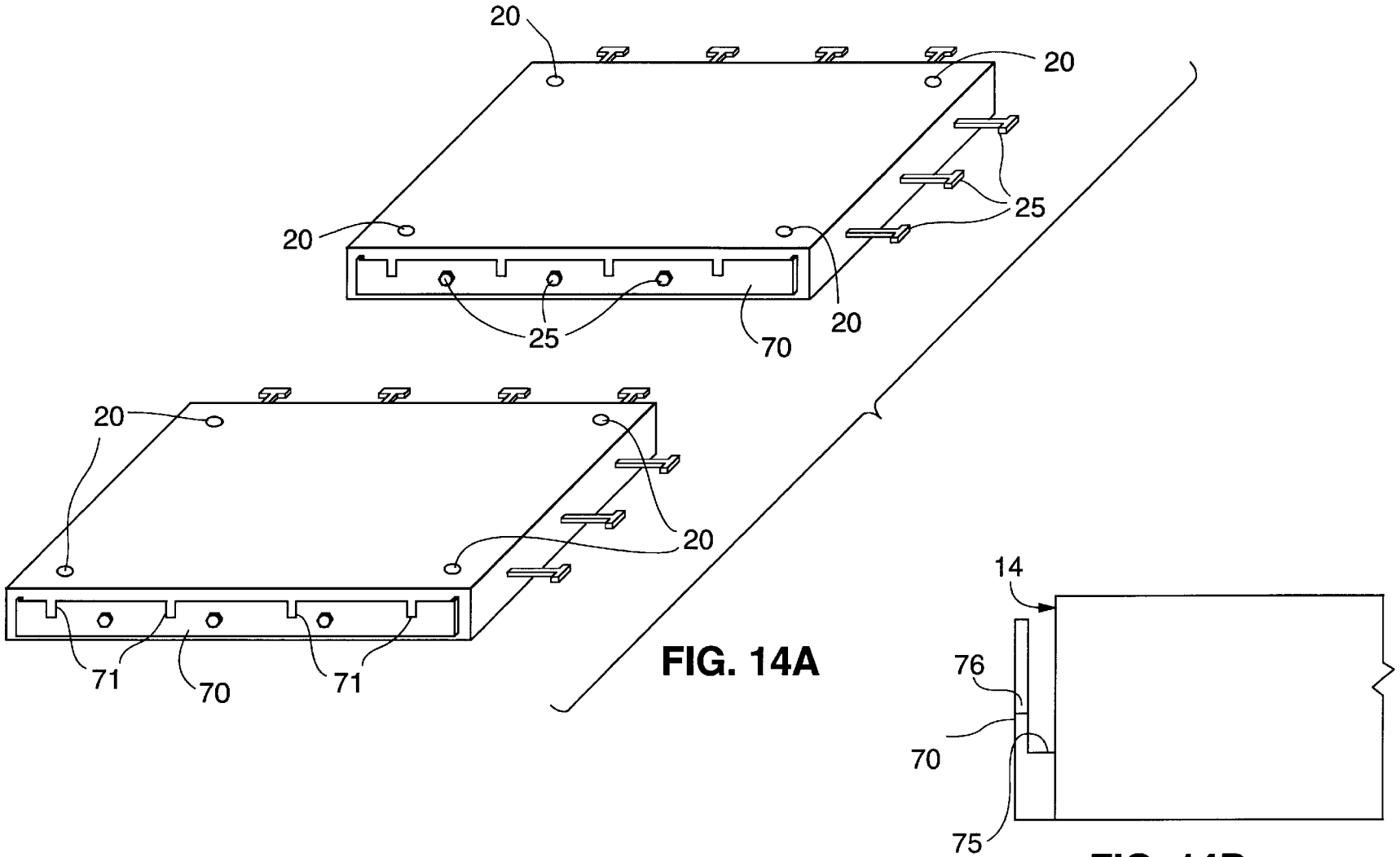
FIG. 14A is another embodiment of a joining means that utilizes protruding bolts of one slab and a receiving plate of another slab, this embodiment entailing one large slotted plate on the side of the slab rather than the individual plates depicted in FIG. 13A.
FIG. 14B is a cross-sectional view through a concrete slab and a slotted plate affixed to one of the slab's sides showing the pocket formed by the slotted plate and the slab. An opening is present within the vertical wall of the slotted plate in those areas where a slot is located in order to accommodate a protruding bolt from another slab.

As depicted in FIG. 14B, the slotted plate 70 and the side of the slab 14 create a pocket 75 into which fits the head of a bolting device 25 protruding from another slab. It is important to note that this bolting device 25 may be of the same type as that used to secure the slotted plate 70 to the side 14 of the slab. The thickness of the pocket 75 must be large enough to accommodate the head of the bolting device, a ¼ inch thickness will generally suffice.

FIG. 14A shows how slots 71 are periodically placed in the slotted plate 70. The slots 71 are created by cutting small, U-shaped sections out of the slotted plate 70, the slots 71 being aligned such that they can receive the bolting device 25 of another slab. Although FIG. 14B represents a cross-section of a slab and slotted plate 70 where there is no slot 71, the area in FIG. 14B labeled "76" defines the space where a slot 71 would be if the cross-section was cut through a plane where a slot 71 was located. Two concrete slabs are connected by inserting the heads of the bolting devices 25 of one slab through the corresponding slots 71 in the slotted plate 70 of the other slab. The slab with the bolting devices 25 is then lowered slightly, such that a portion of the heads of the bolting devices 25 are secured in the pocket 75 within the slotted plate 70.

From the above, it should be evident that the present invention provides a superior alternative to the foundations traditionally employed with portable buildings. The foundation of the present invention is stronger and more durable than those generally used with portable structures; it can also be used in conjunction with building materials presently utilized in the construction of the structures of portable buildings. The concrete slabs of the present invention may be especially useful as foundations for storage facilities and the like. Finally, the present invention provides great flexibility in that multiple concrete slabs can be fastened together to create foundations of varying sizes and shapes.

I claims:

1. A method of erecting a frame of a portable structure on a portable precast concrete slab, comprising the steps of:

(a) providing:

(i) a portable precast concrete slab containing an expanded coil insert, (ii) frame connecting means comprising a U-clip, (iii) means for securing said frame connecting means to said expanded coil insert, and (iv) a frame of a portable structure;

(b) securing said frame connecting means to said expanded coil insert with said securing means; and (c) connecting said secured frame connecting means to said frame, thereby erecting said frame of said portable structure on said portable precast concrete slab.

2. The method as recited in claim 1, wherein said securing means comprises a lift lag.

3. The method as recited in claim 1, wherein said connecting step comprises bolting said frame connecting means to said frame of a structure.

4. The method as recited in claim 1, wherein said frame of a structure comprises a vertical beam.

5. The method as recited in claim 1, further comprising anchoring said portable precast concrete slab to the underlying ground with anchoring means.

6. The method as recited in claim 5, wherein said anchoring means comprises a pipe and two wings pivotally coupled to said pipe, said wings capable of separating, thereby securely embedding said pipe in the underlying ground.

7. A precast concrete slab having frame connecting means for erecting a frame of a structure, comprising:

(a) a body of concrete comprising an upper surface, a lower surface, and side surfaces, said body of concrete being portable;

(b) a plurality of expanded coil inserts embedded within said body of concrete and extending inward from said upper surface; and (c) frame connecting means comprising a U-clip secured to said expanded coil inserts at said upper surface of said body of concrete, said frame connecting means capable of connecting to a frame of said structure.

8. A precast concrete slab as recited in claim 7, wherein one or more edges of said upper surface of said body of concrete are sloped.

9. A precast concrete slab as recited in claim 7, further comprising a plurality of strands disposed within said body of concrete.

10. A precast concrete slab as recited in claim 8, wherein said strands are prestressed.

11. A precast concrete slab as recited in claim 7, wherein said lower surface contains a plurality of ribs positioned at its edges, thereby increasing the thickness of said side surfaces and allowing a portion of said lower surface to be elevated.

12. A method of erecting a frame of a portable structure on a portable precast concrete slab, said concrete slab covering underlying ground, comprising the steps of:

(a) providing:

(i) a portable precast concrete slab containing an expanded coil insert, (ii) frame connecting means, (iii) means for securing said frame connecting means to said expanded coil insert, and (iv) a frame of a portable structure;

(b) securing said frame connecting means to said expanded coil insert with said securing means;

(c) connecting said secured frame connecting means to said frame, thereby erecting said frame of said portable structure on said portable precast concrete slab; and (d) anchoring said portable precast concrete slab to said underlying ground with anchoring means.

* * * * *